United States Patent [19]

Jörss

[11] Patent Number: 4,557,301

[45] Date of Patent: Dec. 10, 1985

[54] METHOD AND MEANS FOR FLOW REGULATION IN CONTAINER FILLING MACHINES

[75] Inventor: Norbert Jörss, Neutraubling, Fed. Rep. of Germany

[73] Assignee: Carl Pirzer, Fed. Rep. of Germany

[21] Appl. No.: 550,019

[22] Filed: Nov. 8, 1983

[30] Foreign Application Priority Data

Nov. 9, 1982 [DE] Fed. Rep. of Germany ..... 3241234
Sep. 29, 1983 [DE] Fed. Rep. of Germany ..... 3335260

[51] Int. Cl.[4] ..... B65B 3/04
[52] U.S. Cl. ..... 141/5; 141/95; 141/102; 141/198; 141/302; 141/144
[58] Field of Search ..... 141/1, 4–7, 141/37–83, 250–284, 285–310, 192–229, 100–110, 129–191

[56] References Cited

U.S. PATENT DOCUMENTS 4,386,635 6/1983 Ahlers ..... 141/198

*Primary Examiner*—Houston S. Bell, Jr.
*Attorney, Agent, or Firm*—Jacobs & Jacobs

[57] ABSTRACT

A method of controlling a filling machine which serves for the filling of containers, particularly for the filling of bottles with a liquid material, and has at least one filling valve for controlling the quantity of material given off, which valve is closed on basis of a first control signal derived from a signal transmitter at the end of the filling phase, when a predetermined condition of filling of the container is reached. An apparatus for the carrying out of this method having at least one filling element which has a liquid channel which discharges into an outlet opening, for instance a filling tube, for the delivery of the filling material to the container and is in communication with a chamber for the filling material, within which liquid channel a filling valve which can be controlled by a signal, preferably by an electrical or pneumatic signal.

35 Claims, 8 Drawing Figures

77
75
84

76
74
78
30
62
80
81
82
66
41
51
52
56
60
29
50
65
27
53
57
61
32
63
58
64
69
54
67
68
59
55
71
70
83
73
72 volume 4
time
I
II
II/1
II/2
II/3

METHOD AND MEANS FOR FLOW REGULATION IN CONTAINER FILLING MACHINES

The present invention refers to a method of controlling a filling machine which serves for the filling of containers, particularly for the filling of bottles with a liquid material, and has at least one filling valve for controlling the quantity of material given off, which valve is closed on basis of a first control signal derived from a signal transmitter at the end of the filling phase, when a predetermined condition of filling of the container is reached.

As a further development, the invention refers to an arrangement for the carrying out of this method having at least one filling element which has a liquid channel which discharges into an outlet opening, for instance a filling tube, for the delivery of the filling material to the container and is in communication with a chamber for the filling material, within which liquid channel a filling valve which can be controlled by a signal, preferably by an electrical or pneumatic signal, is arranged.

In filling machines for the filling of containers, particularly bottles, with a liquid material, an accurately dosed, exact delivery quantity which is not affected in particular by external influences (such as liquid pressure, temperature, viscosity, different volumes of the containers or bottles caused by manufacturing tolerances, etc.) still affords considerable difficulties even today. It has already been attempted to solve these problems by a suitable development of a filling machine or its filling elements and control parts or else by special methods for the control of such a machine.

Insofar as these proposed solutions are purely mechanical structural measures, they are rather expensive as well as susceptible to breakdown and, in particular, they are not of such a nature as to eliminate the aforementioned external influences.

All known measures, in particular also those which employ electrical methods for control and regulation, are based fundamentally thereon that the signal transmitter which produces the first control signal for the closing of the filling valve detects the height of material present within the container to be filled which, based on a discovery which forms the basis of this invention, has extensive disadvantages. Thus the height of the filling material within the container is only an approximate measure of the amount of filling material. Furthermore, influences, for example, such as variations in temperature or, in particular, different volumes of the containers to be filled resulting from manufacturing tolerances cannot be taken into consideration. Furthermore, a relatively expensive conversion is necessary whenever bottles of different size are to be filled with a different quantity of filling material with the use of one and the same bottle-filling machine.

Particularly in the case of those bottle-filling machines in which the liquid material is discharged via filling tubes which extend into the bottles and in which these filling tubes are developed, for instance, as signal transmitters by the applying of electrodes of electrically conductive material, change from one size of bottle to another size of bottle can be effected only by replacing the filling tubes, which are then relatively expensive. Furthermore, not only are these filling tubes expensive, they are also very sensitive, i.e. they must be treated carefully in practical operation and, when not being used, stored carefully, which is only rarely the case in practice.

Furthermore, it has been found that, particularly upon the filling of carbonated liquids such as beer, soft drinks, etc., the filling process can be optimalized by filling of a bottle or a container initially, i.e. for instance up to a partial filling of for instance 10% of the total capacity, at a low rate and then, up to a larger filled quantity of, for instance, 85% of the total capacity, at a much higher rate, whereupon the rate of filling is reduced until the desired total amount of filling has been obtained. This subdividing of the actual filling phase into three or more partial phases, which is advantageous for an optimal filling, can be obtained only with difficulty when using the known methods; at least in the case of all known methods and arrangements these individual phases, or the commencement and termination thereof, are established in more or less fixed form by the structural development of the signal transmitter and are not based, in particular, on the state of partial filling of the container or bottle which has actually been reached.

The object of the invention is to develop a method and an arrangement for controlling a filling machine of the aforementioned type in such a manner that, regardless of external influences, the filling process is terminated when the amount of material which has been fed to a container actually corresponds to the desired total amount of filling, external influences on the dosaged delivery of the liquid material to a container being substantially excluded and the possibility being afforded, in particular, of changing the desired amount of total filling if necessary without expensive conversions or retooling.

Another object of the invention is to provide a method or arrangement which makes it possible, in the case of a filling phase which proceeds at different rates, to change the individual partial phases or the start or end thereof as desired so as to arrive at optimal results.

In order to achieve this purpose, a method of the aforementioned type is developed in accordance with the invention in the manner that by means of the signal transmitter, which is developed as flow meter, the filling quantity flowing to the container to be filled is measured continuously during the filling phase and a pulse signal which corresponds to this quantity is produced, a given number of consecutive pulses in time corresponding in each case to a given amount of partial filling, that the number of pulses is counted and the result thus obtained is compared as actual-value signal with a first preselected desired-value signal, and that when the actual-value signal is equal to the desired-value signal the first control signal is given off in order to close the filling valve.

Since in the method of the invention the quantity of material flowing to the container to be filled is measured by means of the signal transmitter which is developed as flow meter, one always has precisely the desired total amount of material in the filled container, i.e. this filling amount is, for instance, in particular not dependent on differences in volume of the containers resulting from manufacturing tolerances.

The first desired-value signal, which is set, for instance, by means of one or more switches or in some other suitable fashion and is preferably present in the form of a digital signal can be changed without difficulty, and in particular also without mechanical changes of the filling machine, so that the filling of bottles of different size is possible without difficulty on one and the same machine.

Furthermore, the method of the invention affords the possibility of providing, in addition to the first desired-value signal which corresponds to the desired total quantity of filling or the desired final state of filling, another desired-value signal which corresponds to a predetermined condition of partial filling of the container, in which case, when the actual-value signal has reached this further desired-value signal, another control signal is produced which switches from the partial or measurement phase with slow filling rate to a partial or measurement phase at high rate, or vice versa.

The method of the invention is particularly suitable also for controlling back-pressure filling machines in which, during the filling process, the filling phase proper is preceded by a prepressurizing phase during which the containers or bottles to be filled are acted on by a pressurized gas.

For the carrying out of the method of the invention there is particularly suitable an arrangement of the aforementioned type which is characterized by the fact that within the liquid channel which is formed by the filling element there is arranged a signal transmitter developed as flow meter which gives off a number of consecutive pulses in time which corresponds to the volume of flow, that the output of the signal transmitter is connected to the input of a device which counts the pulses, the result obtained in this way being compared as actual-value signal with a predetermined first desired-value signal, and thereupon gives off at an output a signal to an actuating element for the closing of the filling valve when the actual-value signal is equal to the first desired-value signal.

The device to which the signal of the signal transmitter is fed is preferably so developed that the actual-value signal is compared there at least also with one further predetermined desired-value signal and that a further control signal is applied to another output of the device when the condition that the actual-value signal is equal to the desired-value signal has been reached. The output of the device which has this further control signal is connected to an element, upon suitable control, changes the filling rate, i.e. the speed with which the liquid material flows to a container. In a filling machine in which a volume of gas displaced by the filling material flowing to the container is vented via a vent channel, this element for the changing of the filling rate is, for instance, an electrically actuatable valve which, upon opening or closing, changes the effective cross section of the vent channel in at least a partial region of this channel.

If the arrangement or filling machine is one in which a plurality of filling elements are provided on a rotating rotor then the arrangement is preferably developed in such a manner that whenever an individual element is in a predetermined position a control signal for the starting of the filling process is given off when at least two further signals are simultaneously present in this position one of which is produced in positive fashion upon the reaching of this position while the other further signal is present when, in this position, a container is in the prescribed filling position.

The arrangement is furthermore preferably developed in such a manner that when, upon the rotation of the rotor, a filling element has reached a given position in which the filling phase is normally already terminated, another control signal is produced which is fed to the actuating device for the filling valve of this filling element and positively closes the filling valve.

Further developments of the invention form the object of the subordinate claims.

The invention will be described in further detail below with reference to illustrative embodiments shown in the figures of the drawing, in which.

In the figures, 1 is the rotor of a bottle-filling machine of multi-chamber type, the rotor being driven in rotation around a vertical shaft 2. On the periphery of the rotor 1, a plurality of filling elements are attached at identical predetermined distances apart in known manner above lift devices (not shown in detail and also known per se) which are movable up and down in vertical direction and raise the bottles 4 to be filled for the filling process against the filling elements 3 into the filling position and then lower them from this position.

Figure 1:
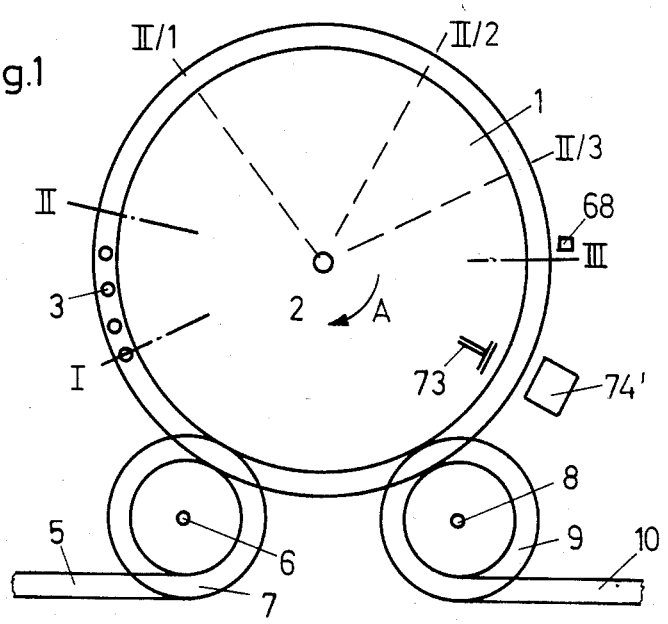
FIG. 1 is a top diagrammatic view of the rotor of a bottle-filling machine together with the individual filling elements arranged on the periphery of this rotor (filling valves) and together with the inlet and outlet spiders of the machine.

The bottles 4 which are to be filled are fed to the filling machine or the resting surfaces formed by the lift members on the rotor 1 via a conveyor member 5 and the entrance spider 7, which is driven in rotation around the vertical axis 6. The filled bottles 4 are removed from the machine via the exit spider 9, which is driven in rotation around the vertical axis 8, and a conveyor element 10 which adjoins said spider. In the showing of FIG. 1, the rotor 1 rotates in the direction indicated by the arrow A.

Within the region of the filling elements, the rotor 1 has an annular liquid chamber 11 for the liquid material to be filled into the bottles 4, for instance beer. Furthermore the rotor 1 has an annular chamber 12 for the pressurizing gas serving for the prepressurizing of the bottles 4 as well as an annular chamber 13 which serves to receive the volume of air or gas which is displaced upon the filling of the bottles 4 and which is in communication with the surrounding atmosphere via a suitable opening, not shown in detail.

Each filling element 3 is connected via three channels with the said chambers, namely via a liquid channel 14 with the chamber 11, via a pressurizing gas channel 15 with the chamber 12, and via a vent channel 16 with the chamber 13.

Figure 2:
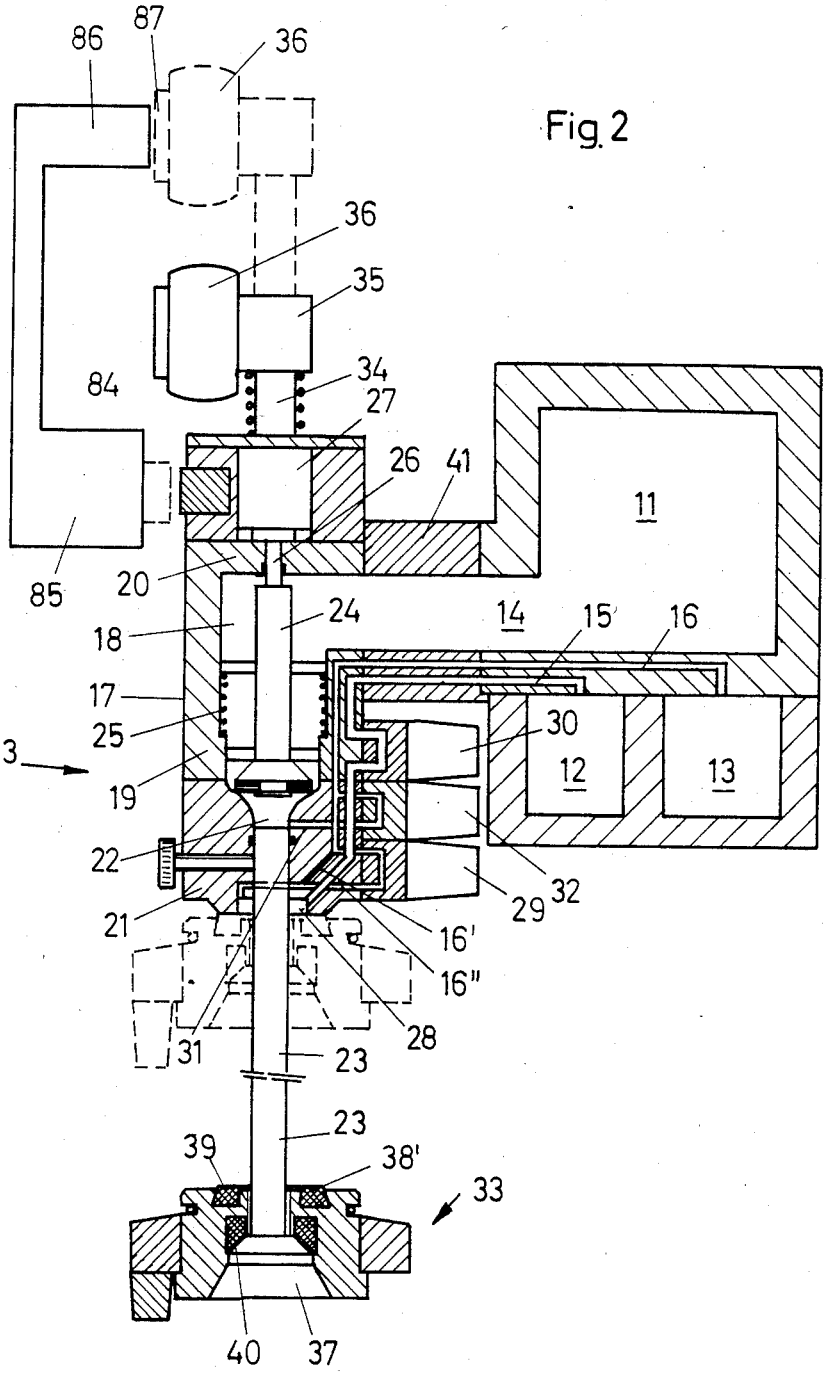
FIGS. 2 and 3 show, in axial section, a part of the rotor of the machine shown in FIG. 1 as well as one filling element of this machine, the filling element being shown in FIG. 2 without bottle to be filled and in FIG. 3 with a bottle to be filled, in a position which the bottle and filling element have in the prepressurizing and filling phases.
Figure 3:
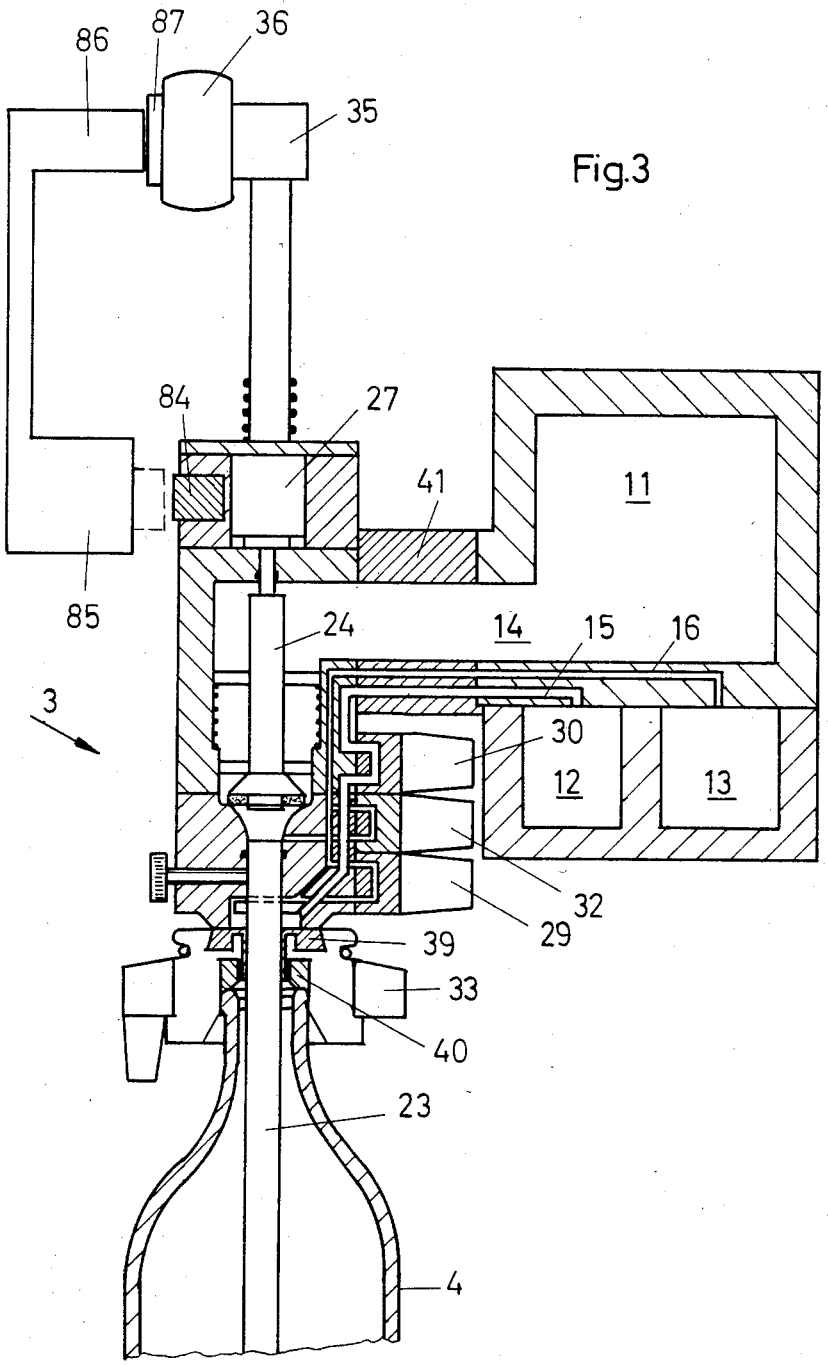

Each filling element 3 consists essentially of a valve housing 17 whose cylindrical inner space 18, which has its axis in vertical direction, is limited by the surrounding wall 19 and by the upper bottom wall 20 in FIGS. 2 and 3. On the bottom, the inner space 18 is closed off by a housing part 21 which has a hole 22 which widens in funnel shape towards the inner space 18 and within which the upper end of a filling tube which is open at both ends is fastened, said tube protruding beyond the bottom of the housing part 21.

The hole 22, on the side thereof facing the inner space 18, has a valve seat for the valve body 24 which is movable up and down in vertical direction within the inner space 18 and thus, as actual filling valve, controls the delivery to the filling tube 23 of the liquid which flows out of the chamber 11, via the channel 15, into the inner space 18. The valve body 24 is urged into the open upper position by a spring 25. The force of the spring 25 is, to be sure, so selected that the valve body 24, in the absence of back-pressure in the hole 22, is held by the pressure of the liquid in the chamber 11 or the inner space 18 in its position resting against the valve seat, and thus closed. For the actuating of the valve body 25, a ram 26 is fastened to the upper end of the valve body, the ram passing in sealed fashion through the bottom wall 20 and being connected to an electric actuating element 27, for instance with the armature of an electromagnet. The electric actuating element 27 which is fastened to the outside of the bottom wall 20, is so developed that when an electric signal is present it holds the valve body 24, against the action of the compression spring 25, in the closed position even if a back-pressure which together with the spring 25 would effect an opening of the valve body 24 or of the filling valve is present in the bore 22.

As furthermore shown in FIGS. 2 and 3, the housing part 21 forms at its bottom a downwards open annular channel 28 which surrounds the filling tube 23 and into which the pressurizing gas channel as well as the vent channel 16 debouch, the latter, however, via a channel section 16′ of reduced cross section with which a channel section 16″ of larger cross section lies in parallel. Within the channel section 16″ an electrically actuatable control valve 29 is provided, the channel section 16″ being interrupted in the one position of this valve while the channel section 16″ is opened in the other position of the control valve 29. Another control valve 30 is provided in the pressurized-gas channel 15. The channels 15 and 16 extend in part through the peripheral wall 19 of the valve housing 17 and through the housing part 21, in which there is also provided an equalization channel 31 which connects the hole 22 and (via the vent channel 16 or its sections 16′ or 16″) the annular channel 28 to each other. In the equalization channel 31 there is provided a third electrically actuatable control valve 32 which is normally closed and is opened only at the end of the filling process after the closing of the valve body 24 so as to deliver also the remaining liquid present in the filling tube 23 into the bottle 4 upon the removal of the filled bottle.

On the filling tube 23 there is a centering bell 33 which is guided movably upward and downward in vertical direction relative to the filling tube 23. For the guiding of the centering bell 33 there are provided two vertical guide bars 34 which are parallel to and spaced from each other, they being arranged on both sides of the filling tube 23 (in front of the filling tube 23 in FIG. 2 and behind it in FIG. 3) and being displaceable in corresponding slide guides on the valve housing 17. The lower ends of the guide bars 34 are fastened to the centering bell 33 while the upper ends of these bars are connected to each other via a connection block 35 to which an actuating roller 36 is also fastened.

The centering bell 33 forms a downwardly conically widening continuous bore or opening 37 which also has in its cylindrical partial region a diameter which is greater than the outside diameter of the filling tube 23 so that an annular channel 38 is formed between the outer wall of the filling tube 23 and the wall of the opening 37. On its top side facing the housing part 21 the centering bell 23 has an annular seal 39. A similar annular seal 40 is provided in the transition region between the cylindrical part of the opening 37 and the conical part thereof so that when the bottle 4 is raised or pressed against the corresponding filling element 3 and the centering bell 33 is thus lifted, the latter rests with the annular seal 39 firmly, sealed off from the outside, against the bottom of the housing part 21 and against the surface 21′ present there which surrounds the channel 28 while at the same time the edge 4′ of the opening of the bottle in question is pressed firmly and outwardly tight against the annular seal 40, as shown in FIG. 3. This condition, shown in FIG. 3, is reached in the normal case, i.e. when no disturbances are present, for each bottle 4 or filling element 3 when the filling element concerned has upon rotation of the rotor 1, reached the position designated 1 in FIG. 1 in which the so-called "prepressurizing phase" commences. The condition shown in FIG. 3 is maintained until the filling element 3 in question and the corresponding bottle have reached the position designated III in FIG. 1. This position corresponds to the start of the removal of the corresponding bottle, i.e. the bottle is lowered again by means of the lift members.

Within the liquid channel 14 between the chamber 11 and the inner space 18 there is arranged a signal transmitter 41 in the form of a flow meter, which has been shown merely diagrammatically in the form of a block in FIGS. 2 and 3. This signal transmitter may, in principle, be of the most different types. Thus, for instance, flow meters operating in accordance with the impeller principle are suitable as signal transmitter, as well as arrangements which employ nozzle and diaphragm members arranged one behind the other in a pipeline and determine the quantity of flow on basis of the pressure differences which occur.

Figure 4:
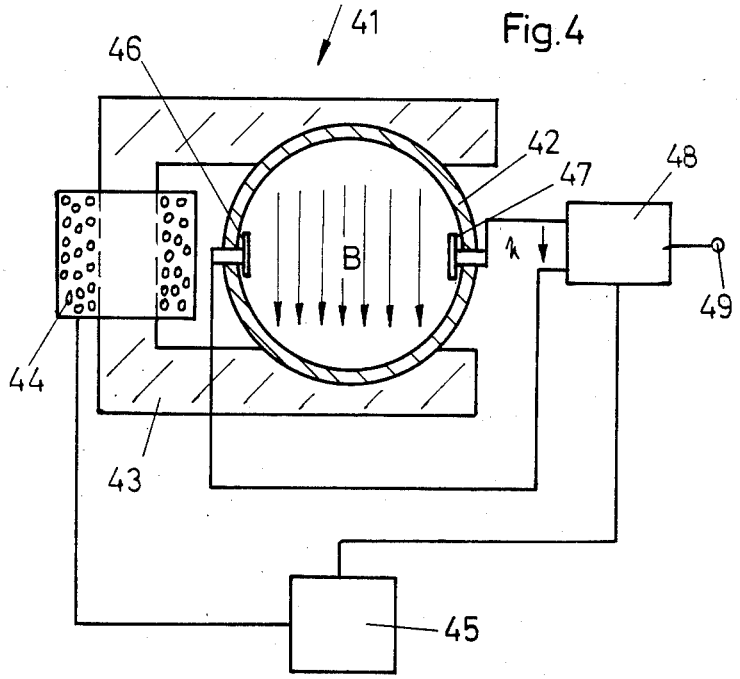
FIG. 4 shows diagrammatically, in cross section, a measurement or signal transmitter for use in the invention.

Insofar as the material to be filled into the bottles 4 is an electrically conductive liquid, as is true of beverages, there may be used as signal transmitter 41 the flow meter which is shown diagrammatically in FIG. 4 and which operates in accordance with the well-known Faraday's law of induction. This flow meter consists of a length of pipe 42 which is traversed by the liquid to be measured and, accordingly, forms a part of the liquid channel 14. The length of pipe 42 is formed of a material of low magnetic conductance, for instance of plastic, copper, brass, etc., and is provided on its inner surface with at least one layer of electrically insulating material. The length of pipe 42 is surrounded by a core 43 of ferromagnetic material, on which core at least one coil 44 is provided. The coil 44 is acted on by a generator 45, which supplies an impressed, switched direct current of low frequency in the region below 50 Hz, so that a magnetic field B which varies with time is produced within the length of pipe 42.

Within the length of pipe 42 there are provided two electrodes 46 and 47 which are connected to the inputs of an electric switch circuit 48. Upon flow of current through the coil 44, i.e. upon the presence of the magnetic field B and upon the flow of the liquid material through the length of pipe 42, a voltage U is present at the electrodes 46 and 47, this voltage being proportional to the product $B \times v \times D$, in which B = the force of the magnetic field v = the average velocity of flow of the liquid material through the length of pipe 42

D = the inside diameter of the length of pipe 42.

By the connecting and disconnecting of the magnetic field B, the voltage U is a pulse or square voltage. Within the circuit 48 the difference between the voltage U in the connected condition of the magnetic field B and the voltage U in the disconnected condition of this magnetic field is formed. The signal present at the output 49 of the switch circuit 48 is then a measure of the average speed of flow of the liquid material through the length of pipe 42 and thus a measure of the amount of material flowing per unit of time through the length of pipe 42. The output 49 forms the output of the signal transmitter 41.

Figure 6:
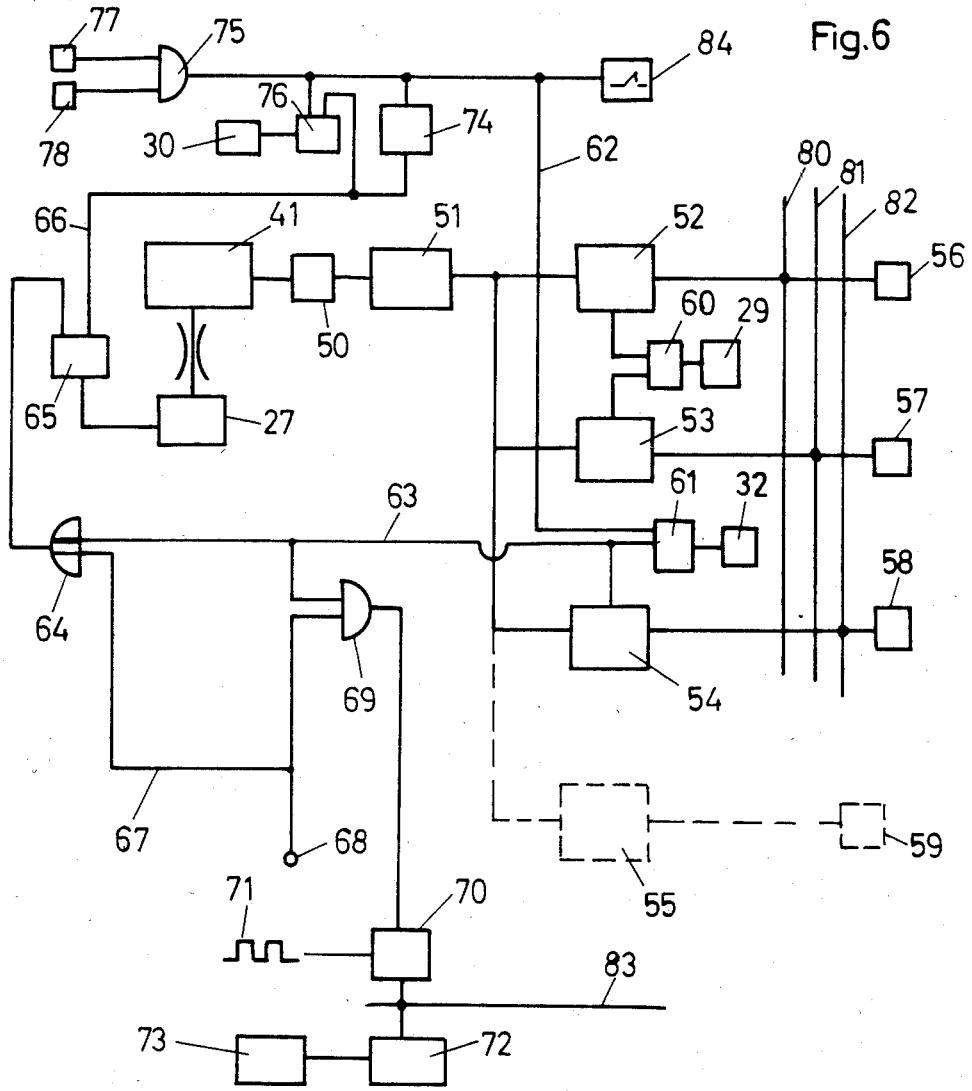
FIG. 6 is a block diagram of one embodiment of the control device of the invention.

If a device which supplies an analog signal proportional to the amount of material is used as signal transmitter 41, then the signal transmitter 41 is connected, according to the embodiment of the control device of the invention shown in FIG. 6, to an analog-digital converter 50 which supplies a pulse signal at its output, a given number of pulses corresponding in each case to a given partial filling quantity. The converter 50 can, of course, be dispensed with if the signal transmitter 41 already supplies a corresponding digital signal.

The output of the converter 50 or the output of the signal transmitter 41 is connected to the input of a counter 51 which counts the incoming pulses and applies to its output in each case a digital signal corresponding to the number of pulses.

In the embodiment shown in FIG. 6 the output of the counter 51 is connected to the inputs of a total of three comparison circuits 52, 53 and 54, in which connection—if this is desired or necessary due to the particular nature of the control of the filling machine—less than three comparison circuits or even more than three comparison circuits can also be provided, as indicated by dashed lines in FIG. 6 for the comparison circuit 55.

Each comparison circuit 52, 53 and 54 and 55 respectively has a second input which is connected to an electric element or circuit 56, 57, 58 and 59 respectively, on each of the outputs of which there is a preferably freely preselectable digital desired-value signal.

Each comparison circuit 52 to 55 provides a signal at its output when the signal (desired-value signal) present at the output of the counter 51 is equal to the desired-value signal set on the corresponding element 56 to 59.

In the embodiment shown the output of the comparison circuit 52 is connected to an input of a control element 60 and the output of the comparison circuit 53 is connected to the other input of the control element 60. The output signal of the control element 60 serves for controlling the control valve 29, the arrangement being such that the control valve 29 is opened when a signal is present at the output of the comparison circuit 52 and is closed when a signal is present at the output of the comparison circuit 53.

The output of the comparison circuit 54 is connected to the one input of a control element 61 which serves to control the control valve 32. The second input of the control element 61 is connected to a signal line 62. The arrangement is such that the control valve 32 is closed when a signal is present on the signal line 62 and is opened when a signal is present on the output of the comparison circuit 54.

The output of the comparison circuit 54 is connected via a signal line 63 simultaneously to the one input of an OR member 64 whose output is connected to the one input of a control element 65. A signal line 66 is connected to the other input of the control element 65 which serves for the control of the filling valve of the corresponding filling element 3 or for the control of the actuating element 27, the arrangement here being such that the filling valve (24) of the corresponding filling element 3 is opened when a signal is present on the signal line 66 and then closes when a signal is present at the output of the OR member 64.

The second input of the OR member 64 is connected via a signal line 67 to a signal transmitter 68 which, in the simplest case, is formed of a pressure switch which is provided on the rotor 1 and associated with each filling element 3, the contacts of said switch closing when the corresponding filling element 3 has reached the position indicated by III in FIG. 1 upon rotation of the rotor 1. This means that a signal which effects a closing of the filling valve or valve member 64 is necessarily always present on the control element 65 when the signal transmitter 68 delivers a signal or when the corresponding filling element 3 has reached position III in FIG. 1.

The output of the signal transmitter 68 is simultaneously connected to the one input of an AND member 69 whose other input is connected via an inverter 70 to the signal line 63.

The output of the AND member 69 is connected to the input of a delay member 70 which is preferably formed by a shift register which, at a second input, is acted on by a clock signal 71 which is derived from the speed of rotation of the rotor 1 and accordingly can also be termed the "machine clock." The output of the delay member 70 is connected to the input of a control element 72 which serves to control an ejector 73 which, in the showing selected for FIG. 1, is arranged fixed in position in the region of the rotor 1 and upon the application of a signal to the output of the AND member 69 is actuated with time delay as a result of the delay member 70 and then forwards the bottle present at this ejector to a receiver 74' for defective bottles or unfilled or insufficiently filled bottles. Since the signal transmitter 68 gives off a signal in position III, the time delay of the delay member 70 is equal to the time which the rotor 1 requires to pass from position 3 to position 4 in FIG. 1. It is self-evident that the ejector 73 may also be arranged outside the rotor 1, for instance in the region of the transport element 10. In such case, a correspondingly larger time delay by the delay member 70 is required.

The signal line 66 is connected to the output of a delay member 74 whose input is connected to the signal line 62 which in its turn is connected to the output of an AND member 75. Furthermore, one input of a control element 76 which serves to control the control valve 30 is connected to the signal line 62. The second input of the control element 76 is connected to the signal line 66 or to the output of the delay member 74, the arrangement being such that in the event of a signal on the signal line 62 or on the output of the AND member 75 the control valve 30 is opened and upon the presence of a signal on the signal line 66 or on the output of the delay member 74 the control valve 30 is closed. The characteristic of the delay member 74 is so selected that the delay signal occurs on the line 66 when, upon rotation of the rotor 1, the filling element 3 in question has reached position II in FIG. 1. Since in the case of the embodiment shown, the delay member 74 has a fixed predetermined delay time, i.e. the time delay produced in the signal by the delay member 74 is independent of the machine clock, position II can change with a change in the speed of rotation of the rotor 1.

The two inputs of the AND member 75 are connected to signal transmitters 77 and 78 respectively, which can then deliver a signal to the AND member 75 when the corresponding filling element 3 is in the position 1 of FIG. 1, the signal transmitter 77 necessarily delivering a signal whenever the corresponding filling element 3 has reached position I while the signal transmitter 78 delivers a signal only when a bottle 4 is also present below the filling element 3. As criterion for this there can be used, for instance, the position of the centering bell 33 or of the connecting block 35 or of the actuating roller 36, i.e. in the event that a bottle 4 is present under the filling element 3 in question these elements are in the raised position, in which connection the signal transmitter 78 which is developed, for instance, as an electric pressure switch, is actuated by the raised actuating roller 36.

In the embodiment of the invention shown in FIG. 6, a separate control circuit is, in principle, associated with each filling element 3, as is shown in this figure, in which connection only the elements 56 to 59 for all filling elements 3 provided on the rotor 1 or for, in each case, given groups of these filling elements can be used jointly, as is indicated by the bus rails 79, 80, 81 and 82 in FIG. 6. The ejector 73 and the corresponding control element 72 are also provided jointly for the control devices of all filling elements 3, i.e. the input of the control element 72 is connected to a bus 83 to which the outputs of the delay members 70 of all control devices are connected.

An essential simplification in construction is possible in the manner that the partial circuit formed by the AND member 75 and the two signal transmitters 77 and 78 is provided only once for all filling elements 3. This is possible, in accordance with FIGS. 2 and 3, in the manner that the control circuit or in the control device for each filling element 3, instead of the AND member 75 there is provided on the rotor 1 a contactor, for instance a reed contact 84, which in closed condition supplies a signal to the signal line 62. On the periphery of the rotor, 1 an electromagnet 85 is provided fixed in space in position I it being connected and actuating the reed contact 84 when, with the actuating roller 36 raised, a switch 86 also arranged fixed in place in position I is actuated by this roller. The switch 86 is, for instance, in its turn a reed contact which, when the centering bell 33 is raised is actuated by a permanent magnet 87 which is arranged in the region of the actuating roller 36 or else at some other suitable point of each filling element 3.

The manner of operation of the control device and of the filling process can be described as follows:

It is assumed that a bottle 4 has duly arrived, at the transfer section between the entrance spider 7 and the rotor 1, onto the resting surface formed by a lift device below a filling element 3 and that the bottle 4, upon reaching position I, has been pressed from below against the filling element 3 so that the bottle 4 and the parts of the filling element 3 have the position shown in FIG. 3. The filling valve of the filling element 3 is closed since the valve body 24 is held in the closed position by the pressure of the liquid material in the chamber 11 or in the inner space 18.

As soon as the filling element 3 has reached position I, the signal transmitter 78 or the reed contact 86 has detected the presence of a bottle 4 and the signal transmitter 78 or the reed contact 84 has reported that position I has been reached so that a signal is also present at the output of the AND member 74 or at the reed contact 84 and thus also on the signal line 62, the control valve 30 is opened. After the opening of the control valve 30, pressurized gas flows via the pressurized gas channel 15, the channel 28 and the channel 38 into the inside of the bottle 4, which is thus prepressurized. The control valve 32 is simultaneously closed in positive fashion by the signal on the signal line 62.

The prepressurizing phase is at an end when the signal present at the signal line 62 appears with time delay at the output of the time delay member 74 and thus at the signal line 66. This delayed signal closes the valve 30 via the control element 76 and opens the filling valve via the control element 65, i.e. the actuating element 27, which in the connected condition up to then held the valve body 24 still in its closed position, is disconnected so that the valve body 24 can open as a result of the biasing by the spring 25 and on basis of the approximately equality in pressure between the pressure in the inner space 18 and the pressure of the pressurized gas in the bore 22.

After the opening of the valve body 24, the filling phase commences, i.e. the liquid material (for instance, beer) flows through the signal transmitter 41 into the inner space 18 and from there through the filling tube 23 into the bottle 4, the volume of pressurized gas displaced at the same time by the incoming filling material being able to escape into the chamber 13 via the channel 38, the channel 28, the constricted region 16' and the vent channel 16. The control valve 29 is still closed at this time.

The signal transmitter 41 or the analog-digital converter 50 behind it delivers to the input of the counter 51 a number of counting pulses which is proportional to the incoming quantity of material. These counting pulses are counted in the counter 51 and the output signal of this counter is compared, first of all in the comparison circuit 52, with a desired-value signal which has been previously set on the element 56. The pressurized gas can only escape slowly from the bottle 4 through the constricted region 16', so that the filling rate is also relatively slow.

As soon as the signal transmitter 41 has detected a certain partial amount of filling and a signal which is equal to the desired-value signal of the element 56 is present at the output of the counter 51, the comparison circuit 52 provides, at its outlet, a signal which leads to the opening of the control valve 29. This opening of the control valve 29 takes place, for instance, when about 10% of the total filling quantity has entered into the bottle 4.

Figure 5:
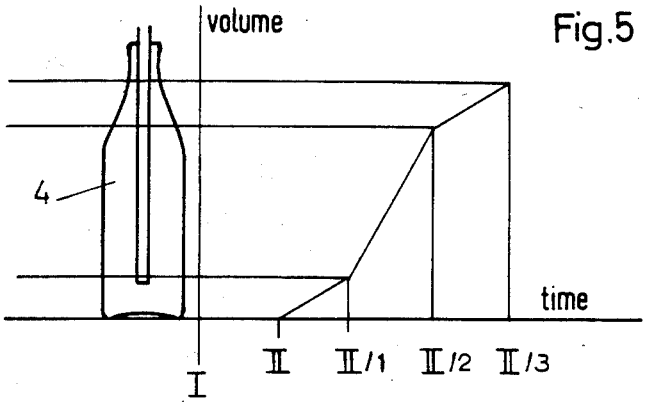
FIG. 5 is a diagram which serves to explain the time course of the filling process, consisting of prepressurizing phase, filling phase and removal phase.

In FIG. 5, the start of the pressurizing phase described above is designated by I and the end of the prepressurizing phase by II. The time at which the control valve 29 opens in the manner described is indicated by II/1 in FIG. 5.

After the opening of the control valve 29, the prepressurized gas which has been displaced by the incoming material can escape faster through the section 16'' of larger cross section so that the rate of filling noticeably increases.

The pulses supplied by the signal transmitter 41 or the analog-digital converter 50 are counted further and the output of the counter 51 is compared, in comparison circuit 53, with the desired-value signal set on the element 57. As soon as the signal at the output of the counter 51 is equal to this second desired-value signal, the comparison circuit 53 delivers, at its output, a control signal which leads to the closing of the control valve 29. This moment, which is designated by II/2 in FIG. 5, is reached when about 85% of the total filling quantity of material has entered the bottle 4.

After the closing of the control valve 29, the volume of pressurized gas displaced by the incoming material can again escape only through the constricted region 16', as a result of which the rate of filling is considerably reduced.

The counting pulses supplied by the signal transmitter 41 or the analog-digital converter 50 are counted further in the counter 51 and the output signal of this counter is compared with the third desired value set on the element 58, which value corresponds precisely to the desired total filling of the bottle 4. As soon as the output of the counter 51 is equal to the desired value set on the element 58, the comparison circuit 54 delivers at its output and thus on the signal line 63, a signal which so actuates the actuating element 27 via the OR member 64 and the control element 65 that the valve body 64 is moved back into its closed position, while at the same time the control valve 32 is opened by the signal on the signal line 63 via the control element 61. After the opening of the control valve 32, there is communication between the inside of the filling tube 23 and the channels 38 and 28 respectively so that even after the closing of the valve body 24 an equalization of liquid is possible between the inside of the filling tube 23 and the inside of the bottle 4, so that, upon the subsequent removal or moving downward of the bottle 4, the amount of material present in the filling tube 23 can still flow into the bottle 4.

The moment at which the valve body 24 closes and the control valve 32 opens is indicated by II/3 in FIG. 5. This moment does not necessarily coincide with the moment when the filling element 3 in question has reached the position III of FIG. 1, i.e. the moment II/3 lies between positions II and III.

The foregoing has shown that the actual filling phase is terminated when, on basis of the signal from the signal transmitter 41, the actually desired total filled quantity set on the element 58 is reached while at the same time also the transition in time between the slow initial filling and the fast filling (position II/1) and the transition in time between the fast filling and the slow final filling (position II/2) are determined by concrete partial filling quantities actually preselected on the elements 56 and 57.

This has the advantage that the course as well as the end of the filling process are optimally controlled corresponding to the actual filling level or corresponding to the actually desired filling quantity regardless of external influences such as, for instance, temperature, pressure, viscosity of the material, etc., as well as regardless of any clogging, in particular in the regions 16' and 16'', or difference in container volumes.

As soon as the filling element in question has reached position III in FIG. 1, the signal transmitter 68 delivers a signal to the OR member 64, whose output signal leads to the closing of the valve body 24 in all cases even if a corresponding closing signal should not yet be present at the output of the comparison circuit 54.

In order to assure a dependable counting of the counting pulses it is necessary that the counter 51 be reset to zero before the start of each new filling phase. This can be done, for instance, in the manner that, with a signal on the output of the OR member 64, a reset signal is fed to the counter 51, preferably with a time delay. The signal present on the signal line 62 by which the entire filling process (consisting of prepressurizing phase and filling phase) is started can also be used for the resetting of the counter 51.

The entire process described is not started if no bottle 4 is in filling position (centering bell 33 raised) in position I under the corresponding filling element 3, i.e. in this case the signal transmitter 58 or the reed contact 86 does not supply a signal so that no signal is present at the output of the AND member 75 or at the output of the reed contact 84. For this reason, neither an opening of the control valve 30 nor an opening of the valve body 24 then takes place.

If, during the filling process, i.e. already in the latter case, the pressure in the bore 22 or in the filling tube 23 suddenly drops and the valve body 24 is pressed into the closed position by the pressure of the liquid filling material within the inner space 18 [sic]. This then also has the result that the output signal of the counter 51 cannot reach a value which is equal to the desired value on the element 50. Also when position III is reached, no signal is thus present on the signal line 63, which has the result that a signal is present at the output of the inverter 70 and thus on the one input of the AND member 69. If at the same time that the position III is reached, a signal is supplied by the signal transmitter 68 to the second input of the AND member 69, then an ejection signal will be supplied from the output of this member to the time delay member 70, which signal then, via the control element 72, actuates the ejector 73 with a time delay, namely if the defective bottle in question has come into the region of the ejector 73.

It was already stated above that the control device shown in FIG. 6 is fundamentally provided separately for each filling element 3 on the rotor 1. However, it has also already been pointed out that certain parts of this control device can be used in common for several filling elements 3 or groups thereof.

Furthermore, simplification is feasible in the manner that, while for each filling element 3 the elements necessary to measure the quantity of material and for producing the counting pulses as well as the control valves and the corresponding control elements are provided separately, nevertheless the evaluation of the measurement signals for all filling elements 3, or groups of these filling elements, is effected by a common central unit in time sequence one after the other, this central unit then comprising at least also the comparison circuits 52–55. The possibility of combining individual functions in a common central unit naturally finds its limit primarily thereby that, particularly with a rapidly rotating rotor 1, i.e. with a filling machine of high output, only a short amount of time is available for the detecting and evaluating of the measurement data.

Figure 7:
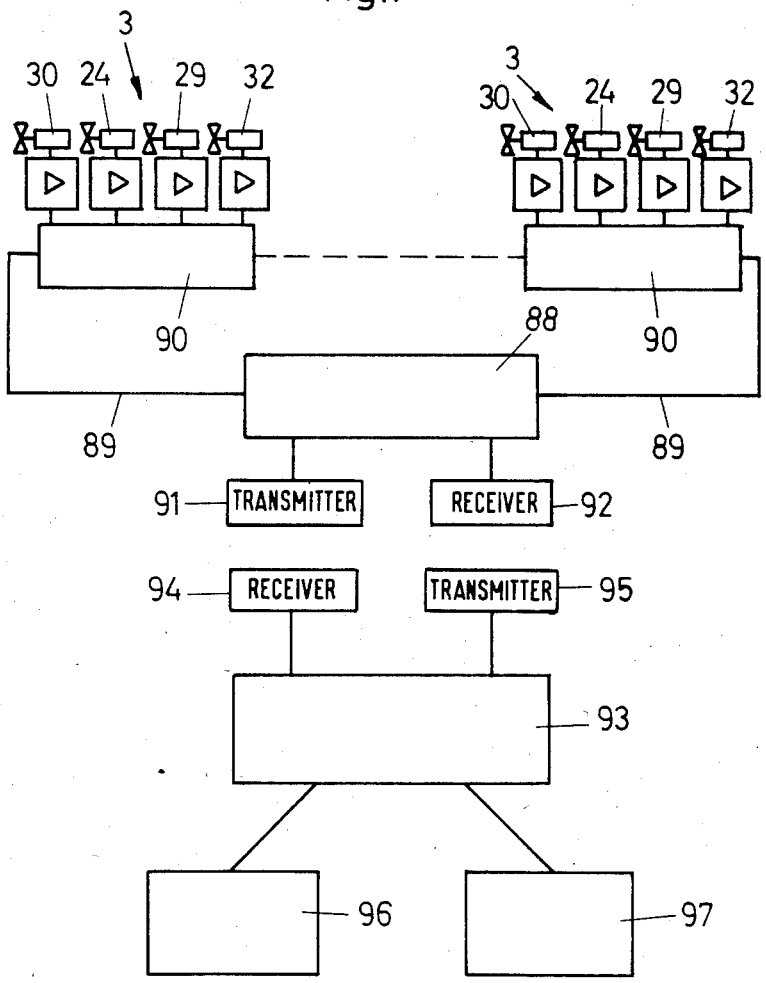
FIG. 7 is a block diagram of an expanded control system in accordance with the invention, having a common central unit associated with a plurality of filling elements.

FIG. 7 shows a further development of the control device according to FIG. 6 in the manner that in each case a common central unit 88 is provided on the rotor 1 for several filling elements 3, or else for groups of these filling elements. This central unit is connected via lines 89 with control devices 90 each of which is associated with a filling element 3, the control devices corresponding, for instance, in their basic development to the control device of FIG. 6. The central unit 88 has an output which is connected to a transmitter 91 and an input which is connected to a receiver 92. On a fixed part of the filling machine there is provided an operating device 93 whose input is connected to a receiver 94 and whose output is connected to a transmitter 95. The operating device 93 furthermore has an input device 96 and an output device 97. Via the transmitter 95 and the receiver 92, or via the transmitter 91 and the receiver 94 the central unit 88 and the operating device 93 work together, the data transmission here being possible in the most different manners, for instance by electromagnetic waves, infrared light, etc.

Various data or commands can be transmitted to the central unit 88 via the input device 96, for instance the input of the desired values as they were described in connection with FIG. 6 and in connection with the elements 56, 57, 58 and 59. In the case of errors which are noted upon the operation of the bottle-filling machine, individual valves of individual filling elements 3 or groups thereof can also be addressed or controlled via the input device 96. Desired values, end-of-filling reports, counter-readings of the individual filling valves or of the corresponding counters can also be obtained via the input device, these data being then outputted to the output device 97.

The output device 97 can furthermore also be used to indicate errors, in particular to indicate defective filling elements 3 or else to indicate the amount of material actually filled into bottles.

The invention has been described above on basis of illustrative embodiments. It is obvious that changes and modifications are possible without thereby going beyond the basic inventive concept of the invention.

Figure 8:
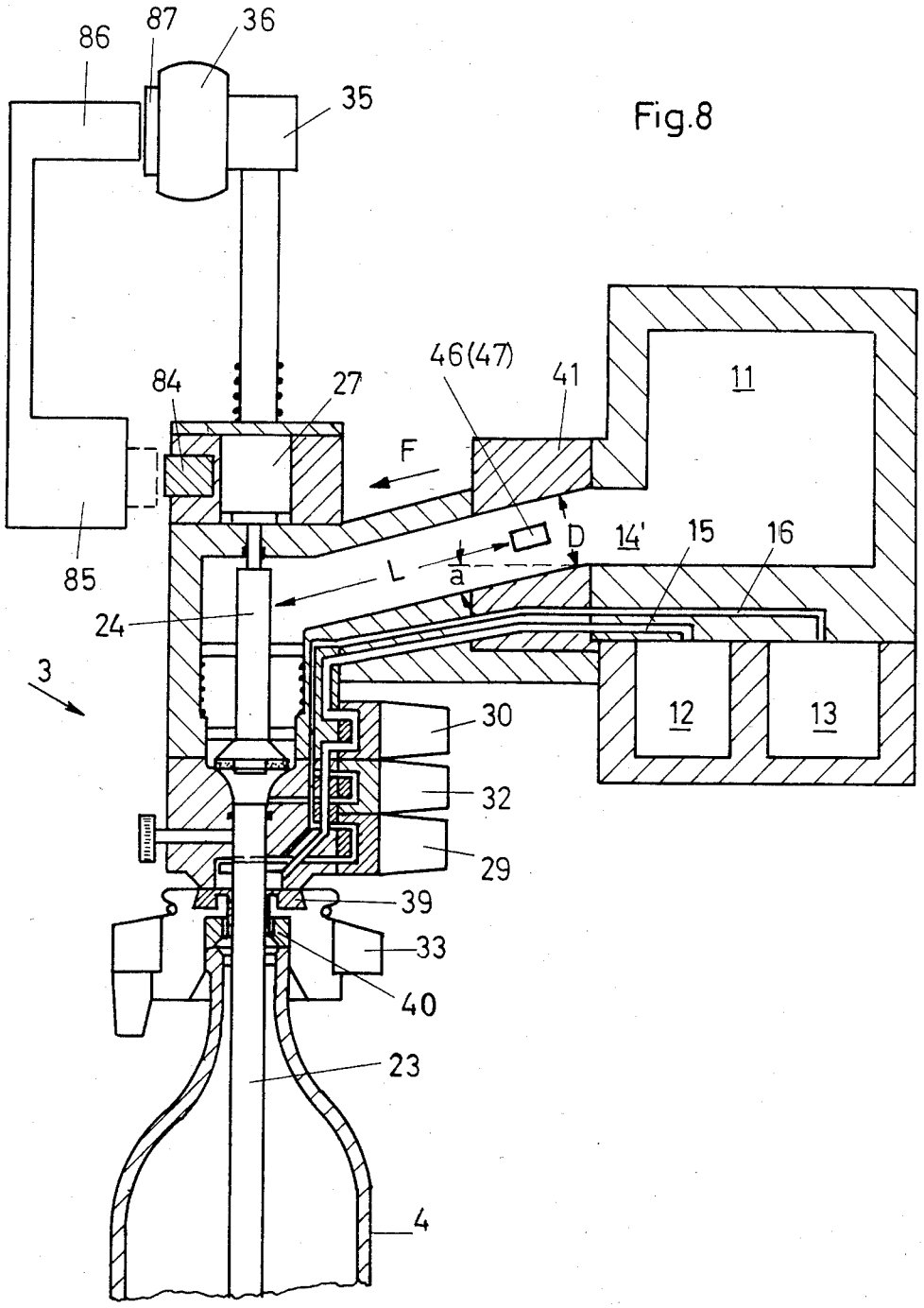
FIG. 8 is a view similar to FIG. 2 but of a modified embodiment.

Thus FIG. 8 shows an embodiment similar to FIGS. 2 and 3 in which, to be sure, instead of the horizontal liquid channel 14 a liquid channel 14' is provided which also extends through the signal transmitter 41 but is inclined downward by an angle a to the horizontal in the direction of flow of the material (arrow F in FIG. 8) so that the outlet end of the channel 14' which is connected to the filling element 3 is lower than the inlet end which is connected to the chamber 1. The angle a is, for instance, 5°. The signal transmitter 41 has the same development as that shown in FIG. 4.

Furthermore, the development of the embodiment shown in FIG. 8 is such that, adjoining the signal transmitter 41 or the measurement paths thereof formed between the electrons [sic] 46 and 47, there is a region of the liquid channel or a flow path for the filling material within which there are no surfaces which reflect the filling material, formed, for instance, by a constriction in its cross section and/or by elements extending into the flow path. The length L of this flow path is equal to about 5 D, D being the diameter which the liquid channel 14' has in the region of the electrodes 46 and 47 and the length of pipe 42 has in this region. The flow path which is free of reflection surfaces preferably has a constant cross section equal to the cross section D.

By the inclined development of the liquid channel 14' as well as by the flow paths which are free of reflection surfaces assurance is had that flow takes place only in the direction of the arrow F in the region of the signal transmitter 41 and therefore not even a partial reversed direction of flow occurs which could lead to an erroneous measurement. Furthermore, air or gas bubbles can escape from the channel 14' or the inner space 18 due to the inclined development of the liquid channel 14'.

I claim:

1. A method of controlling a filling machine for filling containers with a liquid, said filling machine having a filling valve, which comprises opening said filling valve to dispense liquid into a container through said filling valve, continuously measuring with a flow meter the quantity of liquid being dispensed, continuously generating from said measurement an electrical pulse stream corresponding to the quantity of liquid actually dispensed, continuously counting the number of pulses in said pulse stream and generating an electrical actual value signal, continuously comparing the electrical actual value signal with a first preselected electrical desired value signal, generating a first electrical control value signal when said actual value signal is equal to said first desired value signal, and terminating the dispensing by closing the filling valve in response to the first control signal.

2. The method according to claim 1, wherein said first preselected desired value signal corresponds to the maximum quantity of liquid to be dispensed.

3. The method according to claim 1, wherein the dispensing rate is changed at least once so that the entire dispensing is divided into at least a first preceding partial filling phase and a second subsequent partial filling phase with the dispensing rate of filling being changed at the end of the first partial filling phase, the actual value signal being continuously compared with a second preselected desired-value signal corresponding to a predetermined partial filling of the container at the end of the first partial filling phase, generating a second control signal when the actual value signal is equal to the second preselected desired-value signal, and changing the dispensing rate at the end of the first partial filling phase in response to the second control signal.

4. The method according to claim 3, wherein after the first partial filling phase, the dispensing rate is again changed at least a second time by continuously comparing the actual-value signal with at least a third preselected desired-value signal corresponding to at least a second preselected partial filling of the container at least during the second partial filling phase, generating a third control signal when the actual value signal is equal to said preselected third desired-value signal, and changing the dispensing rate at the end of the second partial filling phase in response to the third control signal.

5. The method according to claim 3, wherein the actual value signal in each partial filling phase corresponds to the number of consecutive pulses in time of said pulse signal during the beginning and the end of each partial filling phase.

6. The method according to claim 3, wherein the actual-value signal corresponds to the number of consecutive pulses in time in said pulse signal, which number is counted from the beginning of the entire filling phase.

7. The method according to claim 3, wherein a volume of gas displaced by the liquid flowing into the container to be filled is vented through at least one vent channel in the filling machine, and the effective cross-section in at least a part of said vent channel is changed in response to the second control signal.

8. The method according to claim 4, wherein a volume of gas displaced by the liquid flowing into the container to be filled is vented through at least one vent channel in the filling machine, and the effective cross-section in at least a part of said vent channel is changed in response to the third control signal.

9. The method according to claim 1, wherein the containers to be filled are prepressurized within a preselected time interval in response to a fourth electrical control signal, a fifth electrical control signal is generated after the containers are prepressurized and said dispensing of liquid commences in response to said fifth control signal.

10. The method according to claim 9, wherein the fifth control signal is obtained by time delay of the fourth control signal.

11. The method according to claim 9, wherein the prepressurizing is terminated by said fifth control signal or by a signal derived therefrom.

12. The method according to claim 1, wherein at a predetermined time interval after the beginning of the entire filling phase, a sixth electrical control signal is generated and the filling valve is closed in response to the sixth control signal and independently of the actual-valve signal present at this time.

13. The method according to claim 9 wherein the filling machine has a plurality of filling elements arranged on the periphery of a rotating rotor, with each filling element having a filling valve, the fourth control signal which initiates the filling process is derived by a logical AND function from at least one seventh and one eighth control signal, the seventh control signal being generated when a filling element has reached upon rotation of the rotor a check position associated with the beginning of the filling process and the eighth control signal being generated when a container is in filling position below the filling element which has reached the check position associated with the beginning of the filling process.

14. Apparatus for filling containers with a fluid, comprising a filling element having a liquid channel, a filling valve in said liquid channel, actuating means for opening and closing said filling valve, a signal generator means in said liquid channel for generating a stream of consecutive electrical pulses corresponding to the quantity of liquid that has flowed therethrough, said signal generator means comprising a flow meter, electrical control means including a counter means operatively associated with said flow meter for counting said pulses and for generating an electrical actual value output signal corresponding to the number of counted pulses, and at least one comparator means operatively associated with said counter means for comparing said actual value signal with at least a first preselected desired value signal, said control means being operable to generate a first control signal as a first output when the actual value signal equals the first desired value signal, said actuating means receiving said first output and being operable to close said filling valve in response to said first control signal.

15. Apparatus according to claim 14 wherein said electrical control means is operable to generate a second control signal as a second output when the actual-value signal is equal to a second preselcted desired-value signal, and said actuating means receiving said second control signal.

16. Apparatus according to claim 15, wherein said actuating means is operable to increase the rate of filling in response to said second control signal.

17. Apparatus according to claim 14, wherein said electrical control means is operable to generate a third control signal as a third output when the actual-value signal is equal to a third preselected desired-value signal, said actuating means receiving said third output and being operable to change the filling rate in response to the third control signal.

18. Apparatus according to claim 17, wherein the third control signal effects a reduction in the filling rate.

19. Apparatus according to claim 15, wherein said electrical control means is operable to generate a third control signal as a third output when the actual-value signal is equal to a third preselcted desired value signal, said actuating means receiving said third output and being operable to change the filling rate in response to the third control signal.

20. Apparatus according to claim 19, wherein the filling element has at least one vent channel through which the volume of gas displaced upon filling of the container can escape, a first control valve is arranged within said vent channel, said control valve being controlled by the second or third control signals and having a first position that effects a reduction of the effective cross-section of said vent channel at least within a partial region of said vent channel in order to effect a decrease of rate of filling, and a second position that eliminates said reduction of the effective cross-section in order to increase the rate of filling.

21. Apparatus according to claim 14, wherein the filling element has a gas channel for supplying a pressurized gas into the container to be filled, a second control valve within said gas channel operable to be opened by a fourth control signal.

22. Apparatus according to claim 21, wherein a delay element is provided, the fourth control signal being applied to the input of the delay element and a fifth time delayed control signal being generated as an output of the delay element, and the delayed signal is transmitted to said actuating means for opening the filling valve.

23. Apparatus according to claim 22, wherein the filling valve has a vale member which can move in the filling valve between open and closed positions and which is urged to the open position by a spring and which, upon the absence of opposing pressure in the container to be filled, is held by the pressure of liquid in the filling valve in the closed position, and said actuating means holds the valve member in the closed position even in the event of a counter-pressure within the container to be filled which counter-pressure exceeds the pressure of the liquid, until a fifth control signal is transmitted by the control means to the actuating means.

24. Apparatus according to claim 14, wherein a plurality of filling elements are arranged on the periphery of a rotating rotor and above a table rotating with said rotor, the containers to be filled being fed to the table on a container input position and the filled containers being removed from the table at a container output position, a further signal generator means is provided which produces a sixth control signal when a filling element has been rotated by the rotor to a fixed check position which is situated in the direction of the rotation of the rotor before the container output position, and the sixth control signal is transmitted to the actuating means for effecting a compulsory closing of the filling valve when the filling element reaches the check position, even when the first control signal has not been transmitted to the actuating means.

25. Apparatus according to claim 24, wherein the output of the further signal generator means is connected to a logical OR-element, the other input of which is connected to the first output of the control means and the output signal of said OR-element is transmitted to the actuating means for closing the filling valve.

26. Apparatus according to claim 21, wherein a plurality of filling elements are arranged on the periphery of a rotating rotor and above a table rotating with said rotor, with the containers to be filled being fed onto the table on a container input position and with the filled containers being removed from the table on a container output position, two further signal generator means are provided the output signals of which are transmitted to the inputs of a logical AND-element, that provides on its output the fourth control signal, and one of these further signal generator means transmits a signal to one input of said AND-element whenever, upon rotation of the rotor, a filling element has reached a fixed check position, and the output of the other of said further signal generator means transmits a signal to the other input of said AND-element, when at the check position a container to be filled is in the filling position below the filling element, which has reached the check position upon rotation of the rotor, and the check position follows the container input position in the direction of rotation of the rotor.

27. Apparatus according to claim 14, wherein a plurality of filling elements are arranged on the periphery of a rotating rotor, and separate signal generator means comprising a flow meter as well as a separate control means connected to said further generator means signal are associated with each filling element.

28. Apparatus according to claim 14, wherein a plurality of filling elements are arranged on the periphery of a rotating rotor, a separate signal generator means comprising a flow meter is associated with each of said filling elements, and the control means controls all filling elements.

29. Apparatus according to claim 14, wherein a plurality of filling elements are arranged on a rotor, a separate signal generator means comprising a flow meter is associated with each filling element and several control means are provided, with control means being associated with one group of filling elements.

30. Apparatus according to claim 14, wherein the signal generator means has at least one liquid channel through which the liquid flows and at least one coil which produces a magnetic field in said liquid channel, at least two electrodes are formed in said liquid channel with said electrodes forming between themselves a measurement path, and the liquid channel is inclined downward with respect to the horizontal in the direction of the flow of the liquid.

31. Apparatus according to claim 30, wherein a section of the liquid channel, which is free of reflection surfaces, adjoins said measurement path in the direction of the flow.

32. Apparatus according to claim 31, wherein said section of liquid channel which is free reflection surfaces, has a length that is approximately equal or is up to five times greater than the diameter of the approximately circular liquid channel in the region of the measurement path.

33. Apparatus according to claim 27, wherein a central unit is on said rotor and a fixed operating device is spaced from said rotor, the central unit and said operating device being in communication for data exchange via transmitting means and receiving means, and said control unit is operatively associated with said control means.

34. Apparatus according to claim 28, wherein a central unit is on said rotor and a fixed operating device is spaced from said rotor, the central unit and said operating device being in communication for data exchange via transmitting means and receiving means, and said control unit is operatively associated with said control means.

35. Apparatus according to claim 29, wherein a central unit is on said rotor and a fixed operating device is spaced from said rotor, the central unit and said operating device being in communication for data exchange via transmitting means and receiving means, and said control unit is operatively associated with said control means.

* * * * *